US012085371B1

(12) United States Patent
Adams

(10) Patent No.: US 12,085,371 B1
(45) Date of Patent: Sep. 10, 2024

(54) AMMUNITION PROJECTILE EXTRACTION

(71) Applicant: U.S. Government as Represented by the Secretary of the Army, Dover, NJ (US)

(72) Inventor: Kevin G. Adams, Dover, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 18/220,446

(22) Filed: Jul. 11, 2023

(51) Int. Cl.
*F42B 33/06* (2006.01)

(52) U.S. Cl.
CPC ..... *F42B 33/06* (2013.01)

(58) Field of Classification Search
CPC ..... F42B 33/06; F42B 33/10
See application file for complete search history.

(56) References Cited

U.S. PATENT DOCUMENTS 2,349,248 A * 5/1944 Costello ..... F42B 33/06 86/49
2,828,663 A * 4/1958 Andrade ..... F42B 33/06 86/49
2,970,508 A * 2/1961 Wicks ..... F42B 33/06 86/49
3,107,575 A * 10/1963 Morton ..... F42B 33/10 269/254 R
3,123,369 A * 3/1964 Jacobsen ..... F42B 33/06 279/35
3,602,084 A * 8/1971 Corcoran ..... F42B 33/001 86/45
4,005,630 A * 2/1977 Patrick ..... F42B 33/06 86/49
4,425,833 A * 1/1984 Purdie ..... F42B 33/002 86/44
4,464,958 A * 8/1984 Luks ..... B23B 3/161 29/57
4,527,808 A * 7/1985 Hiestand ..... B23B 31/16254 279/132
6,481,916 B1 11/2002 Hornady et al.
7,568,417 B1 8/2009 Lee
9,709,369 B2 * 7/2017 Ramí Porté et al. ... F42B 33/06
(Continued)

FOREIGN PATENT DOCUMENTS

CN 102901403 B 6/2014

OTHER PUBLICATIONS

"LOCK-N-LOAD 50 Cal. BMG" Press Instructions, Hornady Mfr'g, Grand Island, NE, date unknown.
(Continued)

*Primary Examiner* — Derrick R Morgan
(74) *Attorney, Agent, or Firm* — John P. DiScala

(57) ABSTRACT

An ammunition projectile puller includes a body with one or more jaws to engage the projectile. The jaws can generally displace axially or radially relative to an axis of a through opening, and/or rotate around an axis transverse to the through axis, all within a predetermined range of motion. The jaws obtain a reliable purchase on the projectile to facilitate the extraction. The extracted projectile is cleared from the puller by the insertion of the next projectile to be extracted. The device is thus self-locating, self-locking, self-clearing, tolerant of projectile variation, operable with different projectile types and calibers, reliable, and efficient.

20 Claims, 8 Drawing Sheets

(56) References Cited

U.S. PATENT DOCUMENTS

| | | | | |
|---|---|---|---|---|
| 11,326,864 | B1 * | 5/2022 | McPherson | F42B 33/005 |
| 2014/0318353 | A1 * | 10/2014 | Crandall | F42B 33/001 86/49 |
| 2019/0249967 | A1 * | 8/2019 | Burrow | G01L 5/0028 |

OTHER PUBLICATIONS

"Superfast Bullet Puller Instructions", Forster Products, Lanark, IL, date unknown.

* cited by examiner

-PRIOR ART-

AMMUNITION PROJECTILE EXTRACTION

STATEMENT OF GOVERNMENT INTEREST

The inventions described herein may be manufactured, used and licensed by or for the United States Government.

BACKGROUND OF THE DISCLOSURE

Field of the Disclosure

The present disclosure relates to the field of armaments, and more particularly to extracting a projectile from a cartridge case of a round of ammunition.

Brief Description of Related Art

Referring now to FIG. 9, for nearly a century or more, it has been known to manufacture an ammunition cartridge 910 having a generally cylindrical cartridge case 912 which is open at one end 914. The interior of the cartridge case 912 holds a propellant 917 which, once ignited by a primer 916, gasifies explosively to create the gasses that in turn fire a projectile 918. The projectile 918 is fit into and closes the open end 914 of the cartridge case 912, frequently with a press and/or interference fit. Alternately, in some cases, the cartridge case 912 may be crimped to hold the projectile 918 after it is inserted into the open end 914. In the illustrated example, the holding crimp 920 is circumferential. Alternately or additionally, the crimp 920 may be axial in whole or in part. The exemplary ammunition cartridge 910 depicted in FIG. 9 will be recognizable in its profile and proportions as corresponding to a .50 BMG caliber round, also known as the 12.7×99 mm NATO, including the characteristic shoulder 922 of said caliber round.

It is often the circumstance that cartridges 910, particularly cartridge cases 912, used once to fire a projectile 918 may thereafter be reused, including a "reloading" of them with a replenishment of the propellant, and replacing the primer 916 and projectile 918. Industry has developed certain tools, e.g., a reloading press 10 (e.g., FIG. 7) that are useful in the so-called reloading of ammunition. For example, from time to time, a cartridge 910 may have been reloaded incorrectly. Rather than scrap the incorrectly reloaded cartridge 910, the projectile 918 may be removed from the cartridge case 912, allowing the cartridge 910 to be reloaded to specification.

Alternately, in the field of ammunition research and development, many different parts and parameters of an ammunition cartridge 910 will be modified, altered, and/or interchanged for the purpose of experimentation, to advance the knowledge of the art. In so doing, it is often expedient and efficient to remove the projectile from one or a number of live cartridges, so that the features, components, and/or characteristics of the cartridges may be altered, and through modification, experimentation, and permutation, improvements may be brought forth.

In any of the foregoing use cases, removal of a projectile from a live cartridge presents difficulty. According to one known method, a screw-tightened collet can be attached to the top plate 40 of a reloading press 10 (See, FIG. 7) through an external thread. A loaded cartridge 910 is raised into position on the ram 24, and the collet can be tightened to the projectile 918. By a reverse operation of the press 10 with the projectile 918 held fast in the collet, the projectile 918 may be removed from the cartridge case 912.

This method has several drawbacks. Among these, the screw-tightened collet 40 must be tightened and loosened from each cartridge projectile 918 individually, which is time consuming. Additionally, the collet 44 is prone to lose its hold on the projectile 918 during the extraction stroke, failing the extraction and requiring the collet to be loosened and re-tightened on the projectile once again.

As an alternative to the screw collet described above, there are known one or more claw-type projectile pullers. Claw-type projectile pullers of this type are typically based on a four-bar linkage arrangement. These claw-type projectile pullers have the advantage of jaws of the puller being self-tightening on the projectile by virtue of the pulling action. In certain cases, this gripping of the jaws can be a drawback as well. For example, an excess of gripping force upon the projectile 918 can substantially damage the projectile 918, leading to the case where the extracted projectile 918 is unsuitable for reloading, and is therefore wasted. Moreover, claw-type projectile pullers are inefficient in that they must be independently aligned to the projectile of each cartridge 910 in the press 10.

In one embodiment of a bullet puller, generally 1060, FIG. 10, a flat metal spring washer 1062 would be held in a ring 1064. The ring 1064 may be attachable to a press 10 via exterior threads 1068. The spring washer is divided into plural leaves 1070, in the depicted embodiment four such leaves 1070, along divisions 1072. A central opening 1074 exists to receive the projectile 918. As the projectile enters the central opening, it engages and deflects the leaves 1070 of the spring washer 1062, which holds the projectile 918 and resists movement of the projectile opposite the direction of the deflection.

The device 1060 and those like it are known to be very sensitive to any variations in projectile diameter, even within nominal specification. If the projectile 1018 was on the undersize side of the tolerance range, the device 1060 would fail to grasp. If the projectile 1018 were on the oversize side of the tolerance specification, and/or it were inserted too deeply into the device 1060, it would over-stress the leaves 1070 of the spring washer 1062, which were prone to failure through cracking. Alternately, the leaves 1070 of the spring washer 1062 were known to fail even in ordinary use. The device 1060 thus was a commercial failure for these reasons, and was eventually removed from the market.

There exists therefore a need in the art to be able to safely, reliably easily and efficiently remove a projectile from a live cartridge case, aside from simply firing the cartridge. There exists therefore a need in the art to be able to remove a projectile from a live cartridge case without the removal tool slipping from its grip on the projectile. There exists therefore a need in the art to be able to remove a projectile from a live cartridge case without damaging the projectile. There exists therefore a need in the art to be able to remove a projectile from a live cartridge case with a tool that is self-locating and self-locking with respect to the projectile. There exists therefore a need in the art to be able to remove a projectile from a live cartridge case with a tool that is self-clearing. There exists therefore a need in the art to be able to remove a projectile from a live cartridge case with a tool that can accommodate a certain variation of diameter in diameter of the projectile from nominal specification. There exists therefore a need in the art to be able to remove a projectile from a live cartridge case for a variety of projectile types, including for example ball ammunition, and saboted ammunition.

BRIEF SUMMARY OF THE DISCLOSURE

In order to overcome these and other short comings in the known art, provided according to the present disclosure is an ammunition projectile extraction device for removing a projectile from a cartridge case of a cartridge. The device includes a body with a through hole having a central defining axis, and a diameter restriction dimensioned to engage a structure of the cartridge case and limit the passage of the cartridge into the through hole. An extraction jaw has a working edge facing the defining axis. The extraction jaw has a range of motion relative to the body in an axial direction generally parallel with the defining axis of the through hole, and in a radial direction with respect to the defining axis of the through hole. At a maximum insertion of the cartridge into the through hole, the working edge of the extraction jaw can engage with the projectile of the cartridge, but not with the cartridge case. The combined axial and radial movement of the extraction jaw can yield a range of motion around an axis transverse to the defining axis, such that the working edge translates in a direction away from the body, and is oriented in a direction at least partially away from the body.

According to a further embodiment of the present disclosure the working edge comprises hardened O-1 tool steel, high-speed steel, tungsten carbide, and/or a hardness-enhancing coating applied to any of them or another base material. The working edge is preferably hardened for durability. In a more particular embodiment, the working edge includes a notch generally aligned with the defining axis.

In still another embodiment of the present disclosure, the device includes a second extraction jaw with a second working edge facing towards the defining axis of the through hole. The first and second extraction jaws can be opposed to one another across the defining axis, and/or all extraction jaws of the device are part of a pattern that is spaced in azimuth around the defining axis.

There can be provided a bias element biasing the extraction jaw in a radially inward direction and/or an axially downward direction. In another embodiment of the present disclosure, a shank connected to the body is adapted to mate with and be held by a reloading press of ammunition cartridges. A slot may be provided in an upper surface of the body for receiving the extraction jaw at least partially below the upper surface of the body.

In yet another embodiment of the present disclosure, provided is an ammunition projectile extraction device for removing a projectile from a cartridge case of a cartridge. The device includes a body with a through hole, the through hole having a central defining axis. A pair of extraction jaws is engaged with the body, first and second extraction jaws, each having respective first and second working edges facing towards the defining axis of the through hole. The first and second extraction jaws are engaged with the body so as to permit the first and extraction jaws to have a range of motion in an axial direction generally parallel with the defining axis of the through hole, in a radial direction with respect to the defining axis of the through hole, and around an axis transverse to the defining axis. A bias element biases at least one of the extractions jaws in either a radially inward direction and/or an axially downward direction. The bias element may be a coil spring, a washer spring, a diaphragm spring, a leaf spring, a donut spring, and an elastic, inter alia.

In a further embodiment of the device, the extraction jaws are each translatable in the axial direction, in the radial direction, and/or rotatable around a lateral axis independently of each other. In a more particular embodiment, the through hole has a diameter restriction dimensioned to engage the cartridge case and thereby limit the passage of the cartridge into the through hole. At a maximum insertion of the cartridge into the through hole, the working edges of the extraction jaws can engage with the projectile of the cartridge, but not with the cartridge case.

In still another embodiment, a third and a fourth extraction jaw are provided, each having respective working edges facing towards the defining axis of the through hole. The third and fourth extraction jaws are engaged with the body so as to permit a engaged with the body so as to permit the third and fourth extraction jaws to have a range of motion in an axial direction generally parallel with the defining axis of the through hole, in a radial direction with respect to the defining axis of the through hole, and around an axis transverse to the defining axis. A bias element biases at least one of the third and fourth extraction jaws in either a radially inward direction and/or an axially downward direction.

BRIEF DESCRIPTION OF DRAWINGS

These and other features, benefits, and advantages of the present disclosure will be made apparent with reference to the following detailed description, appended claims, and accompanying figures, wherein like reference numerals refer to like structures across the several views, and wherein:

It will be noted that, although particular sizes, dimensions and/or calibers are discussed at certain points herein with respect to exemplary embodiments of the present disclosure, the drawings are not to scale.

DETAILED DESCRIPTION OF THE DISCLOSURE

Figure 1:
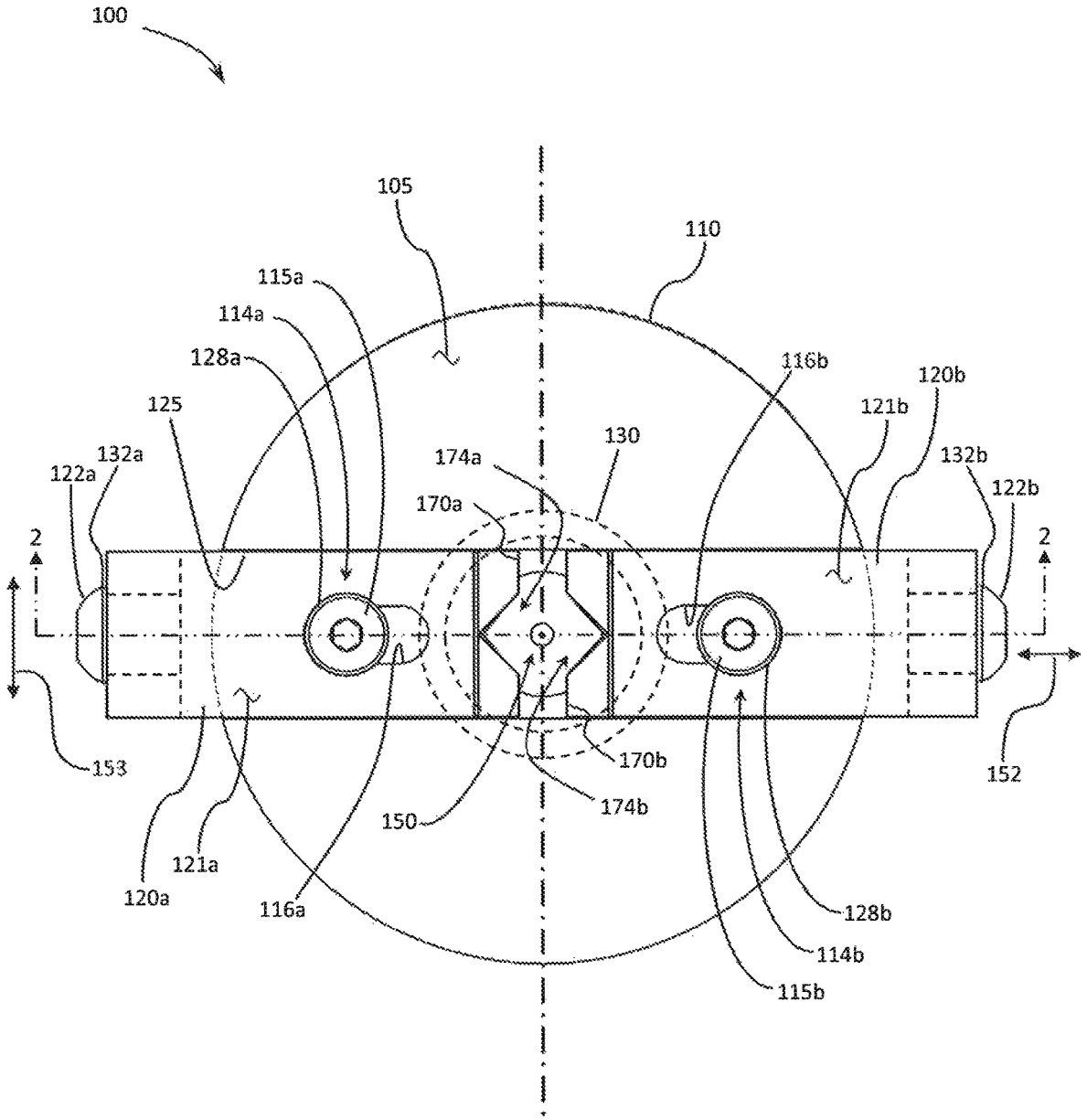
FIG. 1 illustrates a plan view of a projectile puller device according to an embodiment of the present disclosure.
Figure 2:
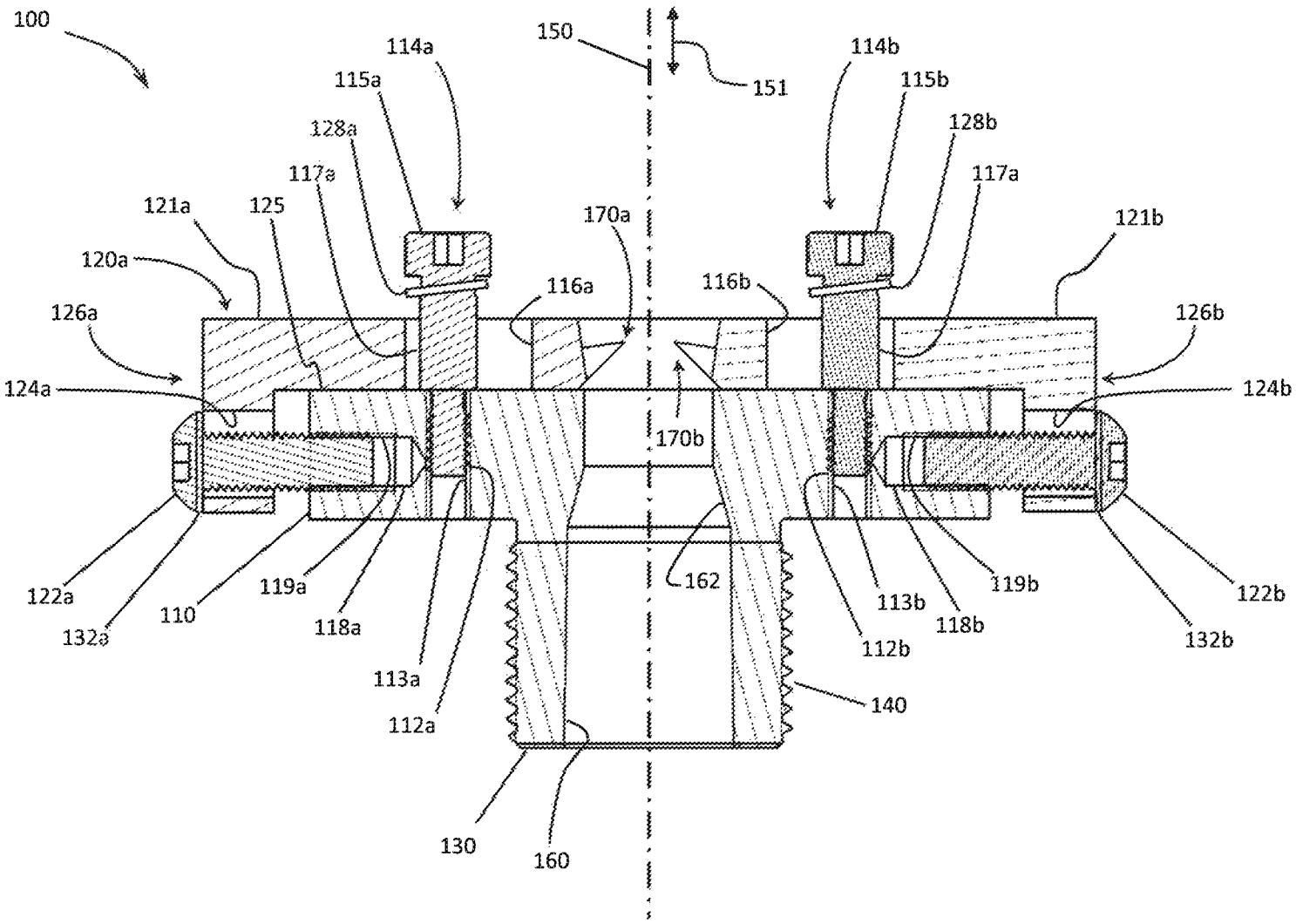
FIG. 2 illustrates an elevational section view of the embodiment in FIG. 1, taken along section line 2-2 thereof.

Referring now to FIG. 1, illustrated is an ammunition projectile extraction device, generally 100, according to a first embodiment of the present disclosure. FIG. 2 is an elevational cross-section of the extraction device 100, taken through section line 2-2 of FIG. 1. The following description will refer to FIG. 1 and/or FIG. 2 collectively and/or interchangeably, as the context will readily admit.

Extraction device 100 has a chassis 110. For one embodiment, the chassis 110 is machined from low alloy steel, in particular 4140 steel. Other materials will be appropriate for choice by one of ordinary skill in the art seeking to balance factors including strength, weight, cost of both material and manufacture, while remaining within the scope of the instant disclosure. The chassis 110 of the exemplary embodiment depicted in FIG. 1 carries a single pair of jaws, each 120*a* and 120*b*, respectively. The jaws 120*a*, 120*b* are advantageously movable relative to the chassis 110 as will be described below. Additionally, the jaws 120*a*, 120*b* are subject to wear in use. Thus, making the jaws 120*a*, 120*b* separable from the chassis 110 and thus able to repair, sharpen, and/or replace the jaws 120*a*, 120*b* presents a cost savings over the life cycle of the device 100.

The jaws 120*a*, 120*b*, may be set within a slot 125 formed in an upper surface of the chassis 110. In the present case, the slot 125 is dimensioned to accommodate jaws 120*a*, 120*b* in a nominal rest position having a respective upper surface 121*a*, 121*b* of the jaws 120*a*, 120*b* flush with an upper surface 105 of the chassis 110. The slot 125 permits displacement of the jaws 120*a*, 120*b* in an axial direction 151 as defined by axis 150, and also in a radial direction 152 with respect to axis 150. The slot 125 generally constrains the movement of the jaws 120*a*, 120*b* in a lateral direction 153, i.e., transverse to the axis 150, except as the lateral direction 153 happens to coincide with the radial direction 152 around an azimuth of axis 150.

In certain embodiments, the jaws 120*a*, 120*b*, are formed of O-1 tool steel. Alternately, the jaws 120*a*, 120*b* or parts thereof may be formed of high-speed steel (HSS). In particular, the jaws 120*a*, 120*b* are advantageously hardened, especially at the working edges 170*a*, 170*b* thereof. A material such as tungsten carbide or the like in hardness may form the working edge 170*a*, 170*b*, or a hardened coating may be applied to either a tool steel, a high-speed steel, a tungsten carbide, or to another base material. The specific geometry of the jaws 120*a*, 120*b*, and in particular the working edges 170*a* 170*b* may be formed by material removal process such as grinding.

In the exemplary embodiment depicted in FIG. 1, two jaws 120*a*, 120*b* are illustrated. A greater or fewer number of jaws may be provided without departing from the scope of the instant disclosure. At least one consideration to determine an appropriate number of jaws is the size of the ammunition/projectile to be extracted. The embodiment of the instant disclosure having two jaws 120*a*, 120*b*, is adapted to the .50 BMG caliber round, i.e., a projectile that is nominally one-half inch in diameter. For small arms ammunition such as .22 caliber, .32 ACP, .380 ACP, 9×19 mm parabellum, or others, a single jaw may be sufficient. Conversely, for larger rounds, in which the projectile 918 requires additional removal force, a greater number of jaws may be desired. The present disclosure is, however, similarly applicable to ammunition including the .223 caliber, 5.56 mm and 7.62 mm NATO rounds, or larger rounds up to and including those fired by 40 mm grenade launcher or larger.

Other factors besides the size or diameter of the projectile 918 may influence the choice of number of jaws. One such factor of influence may include the material characteristics of the projectile 918. The present disclosure is applicable for multiple ammunition types, e.g., whether the projectile 918 is metal jacketed ball ammunition, or alternately saboted ammunition, one example of which is so-called S.L.A.P. ammunition, an acronym for Saboted Light Armor Penetrator. In S.L.A.P. ammunition, an exterior surface of the projectile 918 is typically a polymer plastic. Such differences may impact the ability of the working edges 170*a*, 170*b*, to securely engage the projectile 918. The geometry of the working edges 170*a*, 170*b*, e.g., whether the working edges are provided with a notch 174*a*, 174*b* to assist engaging the projectile 918, may also influence the choice of a number of jaws, and tradeoffs to be made in their selection. For example, a single pair of jaws 120*a*, 120*b*, having a respective notch 174*a*, 174*b*, in each working edge 170*a*, 170*b*, presents four points of contact with a projectile 918. In contrast, an embodiment in which four jaws have no notch in the respective working edge of each similarly presents four points of contact with the projectile 918. It is left to the skill of the artisan to decide whether the expense of manufacture and of maintenance in a jaw having a notched working edge is exceeded by that of additional jaws, as compared to the utility gained by additional points of engagement with the projectile 918.

Figure 3:
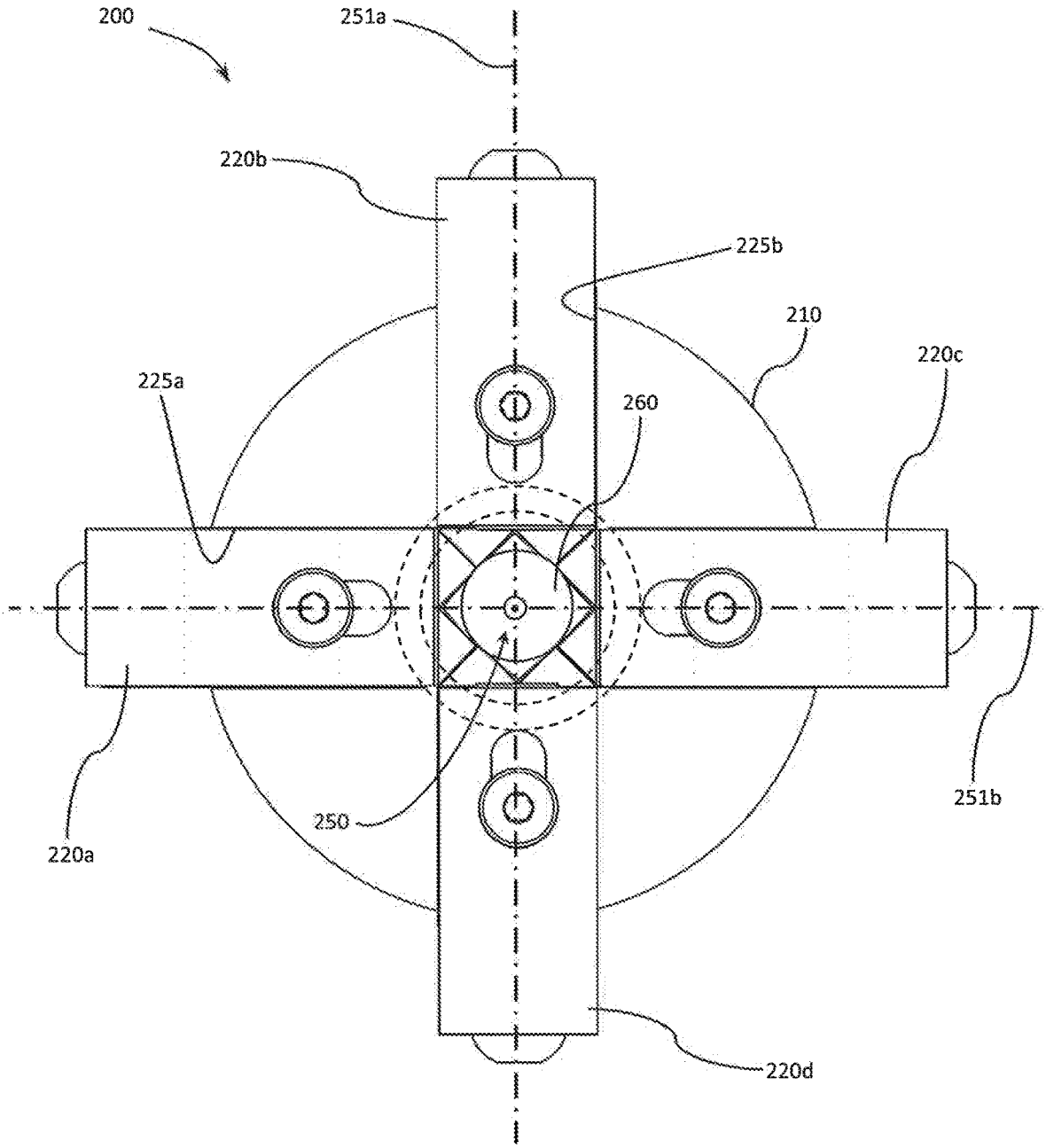
FIG. 3 illustrates a plan view of an alternative embodiment projectile puller device according to the present disclosure.

It is further within the scope of the present disclosure to provide a device 200 as depicted in FIG. 3, having a chassis 210 with plural slots 225*a*, 225*b*, in this case along intersecting axes 251*a*, 251*b*, each being transverse relative to an axis 250 that defines a through hole 260. By maintaining a geometry similar to the prior embodiment of FIGS. 1-2, The two slots 225*a*, 225*b* could accommodate up to four jaws 220*a*, 220*b*, 220*c*, 220*d*. However, four jaws need not be installed for each use of the device 220. Accordingly, the device 200 is still further adapted for use with multiple different ammunition calibers.

Figure 4:
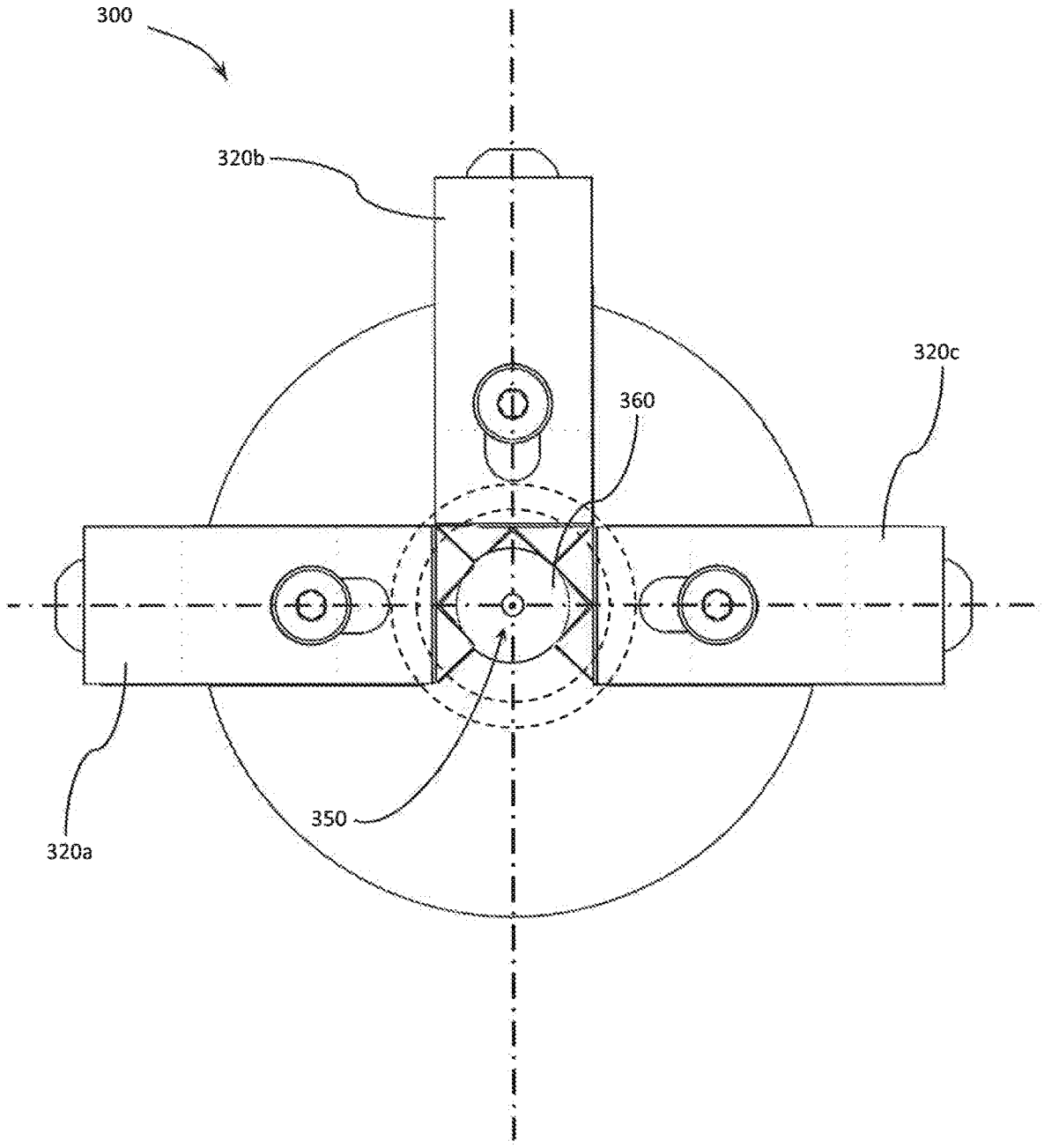
FIG. 4 illustrates a plan view of still another alternative embodiment projectile puller device according to the present disclosure.

The two jaws 120*a*, 120*b* as illustrated in FIGS. 1, et al. are preferably opposed to one another across the axis 150. Any additional jaws provided, particularly where the total number of jaws provided is an even number, may likewise be, but need not necessarily be, directly opposing a counterpart jaw. In cases where an odd number of plural jaws are provided, the plural jaws may be, but need not be, equally spaced in azimuth around an axis 150. Alternately, as illustrated in FIG. 4, device 300 includes three jaws 320*a*, 320*b*, and 320*c*. It may be useful in certain embodiments to have an odd number of plural jaws spaced at regular distance and/or angular intervals around axis 350 from an adjacent jaw, yet the complete set of jaws 320*a*, 320*b*, and 320*c* not necessarily be fully rotationally symmetric around the axis 350. A particular use case might compel irregularly spaced plural jaws, without departing from the scope of the instant disclosure.

Referring again to FIGS. 1 & 2, notwithstanding the ability of the jaws 120*a*, 120*b* to move in the axial direction 151 with respect to the chassis 110 and/or radially within the slot 125, the range of motion of the jaws 120*a*, 120*b* may be limited. For example, in the embodiment depicted in FIGS. 1 & 2, the chassis 110 may include axial holes 112*a*, 112*b*, i.e., at least one corresponding to each of jaws 120*a*, 120*b*. In the depicted embodiment, the axial holes 112*a*, 112*b* may each be provided with an internal thread 113*a*, 113*b*, respectively. Axial holes 112*a*, 112*b* may thus each receive and hold a respective axial fastener 114*a*, 114*b* via internal thread 113*a*, 113*b*. The jaws 120*a*, 120*b* may be provided with longitudinal slots 116*a*, 116*b*, which each allow the pass-through of the axial fasteners 114*a*, 114*b* respectively. The length of the slots 116*a*, 116*b* in the radial direction 152 will permit the jaws 120*a*, 120*b* to move in the radial direction 152 relative to axis 150. In one case axial fastener 114*a*, 114*b* is a shoulder bolt, including a rounded length 117*a*, 117*b*, of smooth diameter and without external threads, generally for engaging the interior of the longitudinal slots 116*a*, 116*b*. However, the fastener and/or thread chosen can and will vary according to the particular application.

Axial fasteners 114*a*, 114*b* in engagement with axial holes 112*a*, 112*b* via internal threads 113*a*, 113*b* will constrains the jaw 120*a*, 120*b* in the axial direction 151 due to the dimension of the axial fastener heads 115*a*, 115*b*. Specifically, the width of the axial fastener heads 115*a*, 115*b* will be greater than the width of longitudinal slots 116*a*, 116*b* provided in the jaws 120*a*, 120*b*. An amount of movement in the axial direction 151 permitted by the axial fasteners 114*a*, 114*b*, is adjustable by the depth of engagement of the axial fasteners 114*a*, 114*b*, with the internal threads 113*a*, 113*b*.

In addition to slots 116*a*, 116*b*, it may further be advantageous to limit the radial movement of the jaws 120*a*, 120*b* by other means. For this purpose, radial holes 118*a*, 118*b* are provided in the chassis 110. Here again, like axial holes 112*a*, 112*b* described above, there is provided at least one of radial holes 118*a*, 118*b*, to correspond to each of the jaws 120*a*, 120*b*. Radial holes 118*a*, 118*b* may each include an internal thread 119*a*, 119*b*, respectively. In this way, radial holes 118*a*, 118*b* may each receive a respective radial fastener 122*a*, 122*b*, chosen to match the corresponding thread size of radial holes 118*a*, 118*b*. In the exemplary case, radial fastener 122*a*, 122*b* is a button head screw, although the particular fastener chosen will be within the skill of those of ordinary skill in the art having possession of the Instant disclosure.

Each of the jaws 120*a*, 120*b* is provided with a through hole 124*a*, 124*b* formed through a respective tab portion 126*a*, 126*b* of each jaw 120*a*, 120*b*. Through holes 124*a*, 124*b* each pass a respective radial fastener 122*a*, 122*b* in their engagement with radial holes 118*a*, 118*b*. Radial fasteners 122*a*, 122*b* may constrain the jaws 120*a*, 120*b* in a radial direction 151 relative to axis 150, i.e., a horizontal direction as viewed in FIG. 2. It is contemplated that through holes 124*a*, 124*b* are large enough, relative to radial fasteners 122*a*, 122*b*, to accommodate a at least some vertical movement and/or rotational translation of the jaws 120*a*, 120*b*, consistent with the foregoing description of axial holes 112*a*, 112*b*, et seq. Alternately, the through holes 124*a*, 124*b* may be elongated in the axial direction 151 to accommodate such movement.

Figure 7:
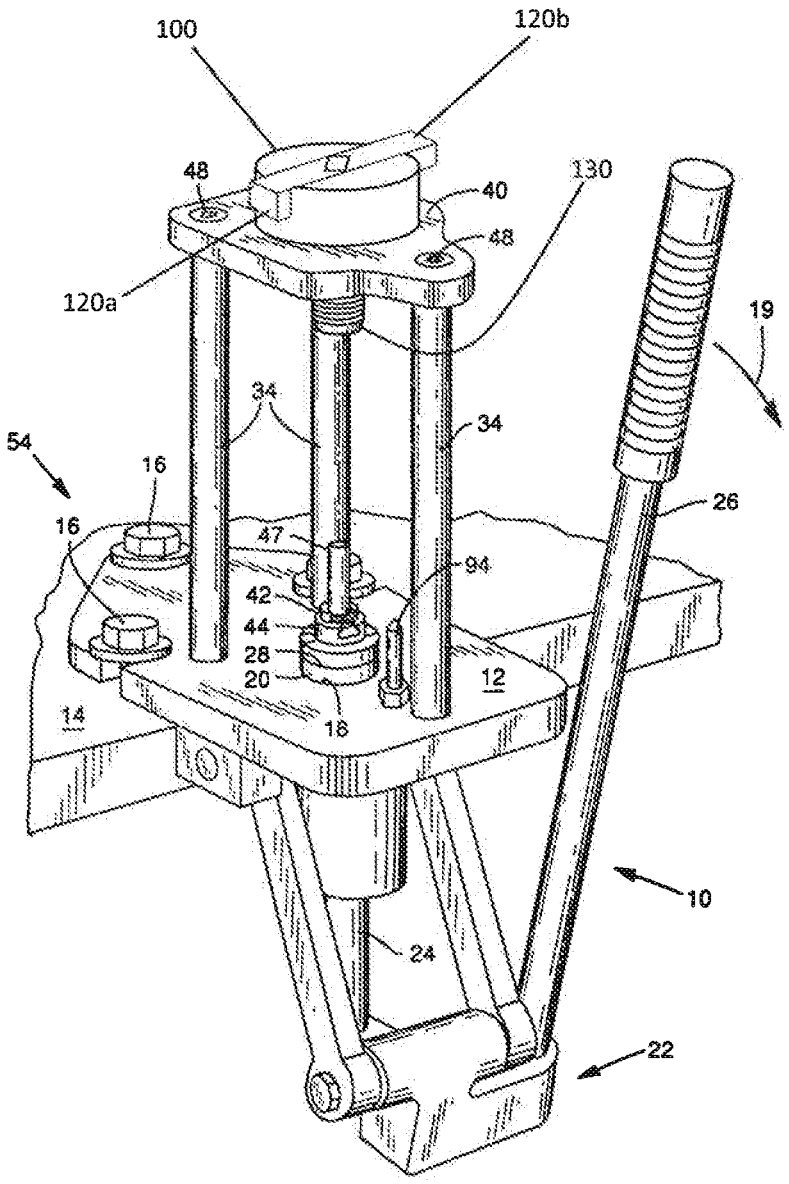
FIG. 7 illustrates a perspective view of a projectile puller device according to an embodiment of the present disclosure in use with an ammunition reloading press.

The chassis 110 may include a shank 130 extending therefrom, by which the chassis 110 and therefore the extraction device 100 may be engaged with a machine, e.g., a reloading press 10 as shown in FIG. 7, to apply the forces necessary to remove and/or engage a projectile 918 with a cartridge case 912. It may be advantageous to apply a commonly standardized mounting feature to the shank 130, for example an exterior thread 140. Bayonet-type lugs may be substituted for the exterior thread, where the counterpart mounting hardware is provided.

The chassis 110 is further provided with a through opening 160 to receive the cartridge 910. The direction of the through opening 160 is defined by the axis 150. As in the exemplary embodiment illustrated, this through opening may be sized to mate with and accept one or more particular geometric features specific to one or more respective calibers of cartridge 910. In the present case, the through opening 160 is characteristic in profile to the cartridge case of a .50 BMG caliber round. In particular, owing to the desire to mate with a .50 BMG caliber round in particular, through opening 160 includes a shoulder portion 162, where the diameter of the through opening 160 is restricted. This shoulder 162 will be understood to correspond to a similar geometry shoulder 922 of the .50 BMG caliber round.

However, an extraction device 100 within the scope of the present disclosure is hardly limited to any single caliber of ammunition. Other ammunition calibers will have their own distinctive geometric features which may be used to locate the cartridge case 912 with respect to the working edges 170*a*, 170*b*. At a bare minimum, the cartridge case 912 itself will have a larger diameter than the projectile 918, making the forward edge of the cartridge case 912 a feature upon which a diameter restriction 162 of the through opening 160 may bear. Indeed, the through opening 160 may be sized, dimensioned, and include features to accommodate any other, or even multiple, ammunition sizes.

In the exemplary and other embodiments, the geometry and position of the through opening 160, and one or more internal features such as shoulder 162, serve to locate and position the cartridge 910, and more specifically the projectile 918, with respect to the jaws 120*a*, 120*b* and their respective working edges 170*a*, 170*b*. Additionally, the shoulder 922 of the cartridge case 912 and the corresponding shoulder 162 of the through opening 160 prevents any engagement between the working edges 170*a*, 170*b* of jaws 120*a*, 120*b* on the one hand, and the cartridge case 912 on the other. Engagement between the working edges 170*a*, 170*b* and the cartridge case 912 is possible to result in damage either or both the jaws 120*a*, 120*b* and the cartridge 910.

Engagement between the jaws 120*a*, 120*b* and the projectile 918 is aided by the application of a force to bias the jaws 120*a*, 120*b* in either or both downward in axial direction 151 and inward in radial direction 152. In certain embodiments, the force is supplied by a bias element 128*a*, 128*b*, between the jaw 120*a*, 120*b*, and the axial fastener 114*a*, 114*b*, more specifically the axial fastener heads 115*a*, 115*b*. Alternately or additionally, a bias element 132*a*, 132*b* is provided between the radial fastener 122*a*, 122*b* and the tabs 126*a*, 126*b*. The bias elements 128*a*, 128*b* and/or bias elements 132*a*, 132*b* may be any of a coil spring, a washer spring, or a diaphragm spring. In still other embodiments, a leaf spring or a donut spring may be used as bias elements.

Figure 8:
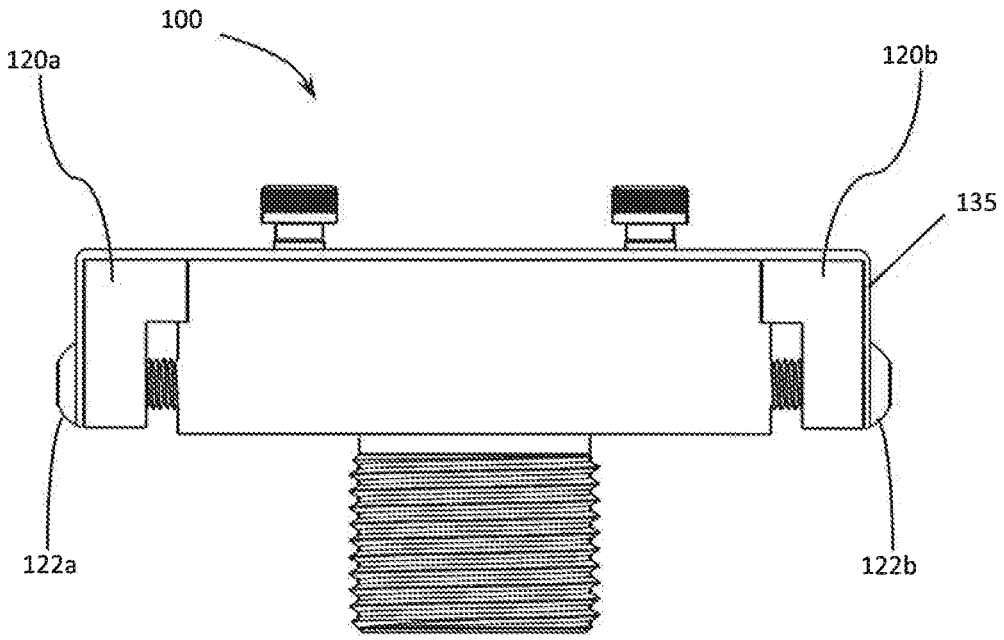
FIG. 8 illustrates a front elevation view of a projectile puller according to the present disclosure, including a bias element biasing a pair of jaws.
Figure 9:
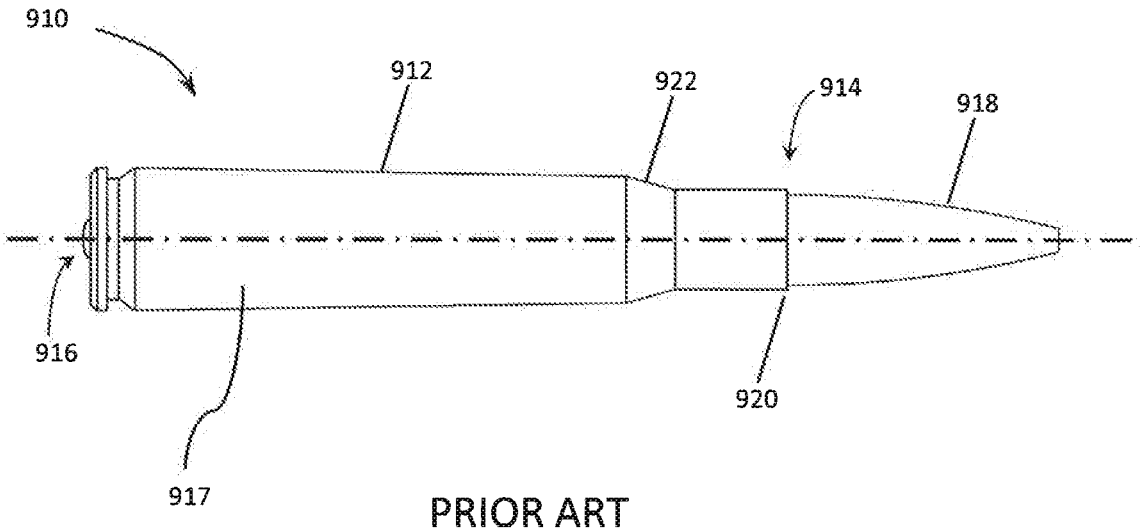
PRIOR ART Fig. 9
FIG. 9 illustrates an elevation view of an ammunition cartridge according to known art.
Figure 10:
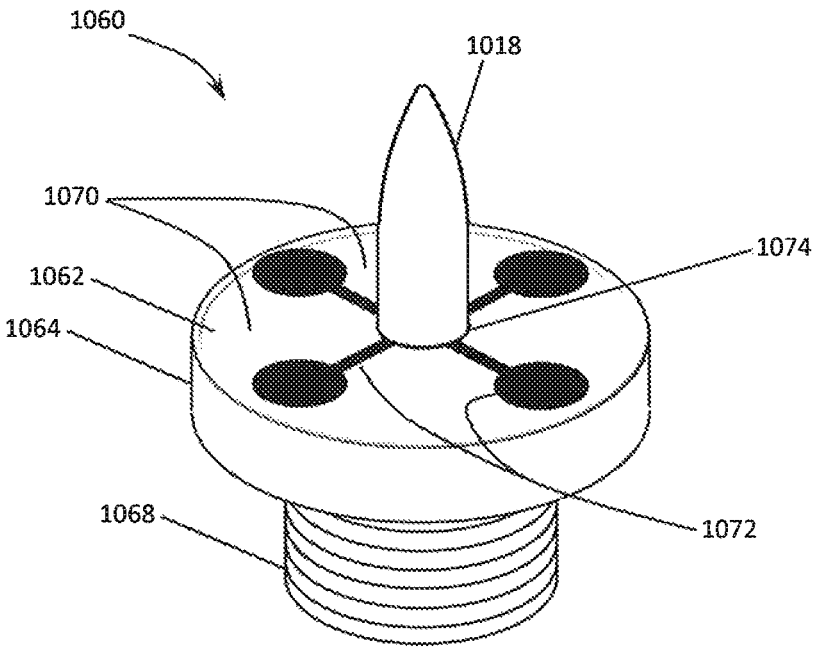
FIG. 10 illustrates a perspective view of a projectile puller device based upon a spring washer according to known art.

Referring now to FIG. 8, depicted is a front elevation view of a projectile extractor according to another embodiment of the present disclosure. As illustrated in FIG. 8, the bias element is an elastic 135, e.g., a band, strap, and/or loop. The elastic 135 may be provided between the radial fasteners 122*a* and 122*b*, and over jaws 120*a*, 120*b*, thus applying a force to jaws 120*a*, 120*b* both radially inward and axially downward.

In still another embodiment of the present disclosure, the slot 125 is formed as an undercut slot within the chassis 110. Accordingly, a portion of the chassis 110 would overlie the slot 125, and could function to capture and thereby limit the axial movement of the jaws 120*a*, 120*b*. Where a biasing element is provided to bias the jaws 120*a*, 120*b*, as described hereinafter, it may be provided between the portion of the chassis that overhangs the slot 125, and the jaws 120*a*, 120*b*. Similarly, a further embodiment can integrate a capture and/or restriction of radial motion into the chassis 110, with a radial bias element, if provided, likewise bearing against that portion of the chassis to capture the jaws 120*a*, 120*b* in the radial direction.

Figure 5:
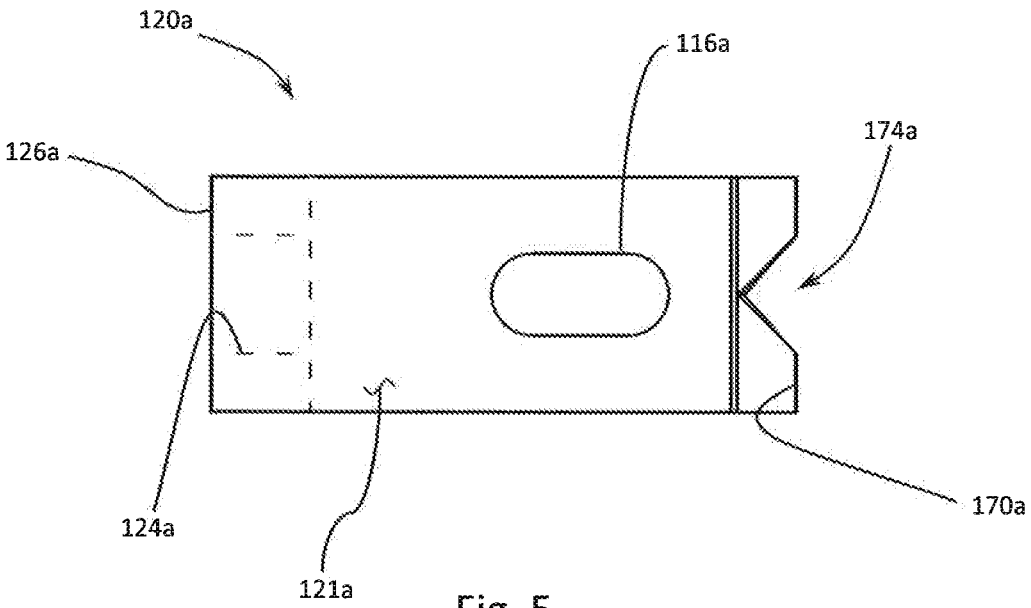
FIG. 5 illustrates a plan view of a projectile puller jaw according to the first embodiment of the present disclosure.
Figure 6:
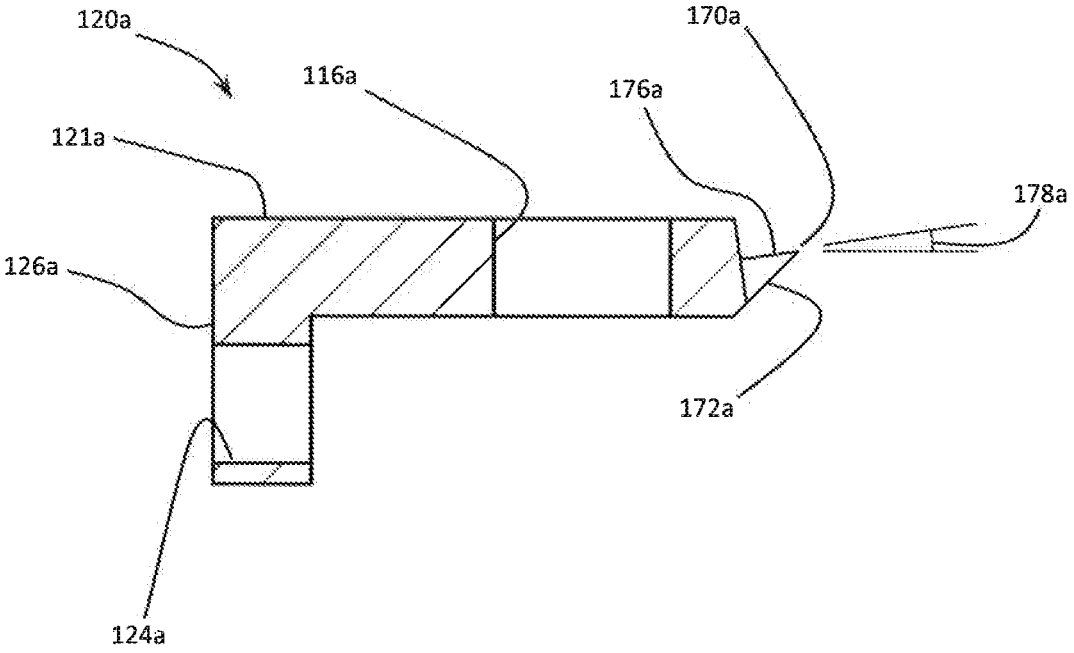
FIG. 6 illustrates an elevational section view of the projectile puller jaw depicted in FIG. 5, according to the present disclosure.

Further detail can be seen with respect to FIG. 5, which illustrates the jaw 120*a* in isolation from the device 100, in a plan view. FIG. 6 illustrates the jaw 120*a* in cross-section taken along the same section line 2-2 of FIG. 1. In the exemplary embodiment, the counterpart jaw 120*b* will have identical features, rotationally mirrored around axis 150. The jaw 120*a* is provided with a working edge 170*a*. The working edge 170*a* is preferably formed or shaped, and hardened, making it more resilient to wear in use. The working edge 170*a* preferably has an undercut 172*a*. The undercut 172*a* provides additional clearance for the insertion of the cartridge 910, and help to focus the engagement of the working edge 170*a* with the projectile 918.

In the instant embodiment, working edge 170*a* includes a notch 174*a* formed therein. The notch 174*a* is substantially aligned, in a transverse direction 153, relative to the axis 150. Providing such a notch 174*a* increases the number of points of engagement between the working edge 170*a* on the one hand and the projectile 918 on the other. In the exemplary embodiment depicted in present FIGS. 1, 5, etc., the walls of each notch 174*a*, 174*b* form a roughly 90-degree angle with each other. In other embodiments, the angle formed by the walls of each notch 174*a*, 174*b* may be greater or less. Alternately, the shape of the notch may be arcuate, in particular concave with a radius selected to match the projectile diameter of a predetermined caliber of ammunition.

According to a further embodiment, the upper surface 176*a* of the working edge 170*a* exhibits a relief angle 178*a* such that each working edge 170*a* itself is advanced, in the axial direction 151, compared with the material supporting it along the upper surface 176*a*. In a particular embodiment, this relief angle 178*a* is about 8° relative to horizontal.

Further details of the extraction device 100 will be described hereafter with respect to its operation as shown in FIG. 7. With the exception of the presently disclosed extraction device 100, the remainder of the press 10 depicted is disclosed by U.S. Pat. No. 5,202,529, issued 13 Apr. 1993 to Shields ("Shields '529"), specifically FIG. 3 of Shields '529. The entire content of Shields '529 are hereby incorporated by reference for all purposes, and at least insofar as necessary to describe any features depicted in FIG. 7. Now some 30 years' since the patent was granted, the press 10 of Shields '529 is not especially unique at present. The Shields '529 press 10 is offered as archetypical of a number of ammunition reloading presses, and illustrates the adaptability and/or interoperability of the presently disclosed projectile extraction device 100.

The extraction device 100 may be attached to the die station, i.e., top plate 40 of the reloading press 10. A reloading press 10 may include a moveable ram 20 upon which a shell holder 42 is mounted to hold a cartridge case 47. A live ammunition cartridge 910 is thus thereby located by the shell holder 42 and is thereafter advanced towards the mounted extraction device 100 through operation of the handle 26. The cartridge 910 will pass into through opening 160, and in the case of the exemplary .50 BMG caliber round (among others), a shoulder 922 of the cartridge case will bear against a shoulder 162 of the through opening 160. In the particular embodiment illustrated, the location of the shoulder 162 thus locates the projectile 918 with respect to the jaws 120*a*, 120*b*.

More specifically, at the upward extent of the stroke of the ram 20, the projectile 918 presses against the jaws 120*a*, 120*b* to engage each working edge 170*a*, 170*b*, preferably within the notch 174*a*, 174*b*, if provided. The projectile 918 pushes axially upward and radially outward on the jaws 120*a*, 120*b*, to the extent permitted by axial fasteners 114*a*, 114*b*, and/or radial fasteners 122*a*, 122*b*. The working edges 172*a*, 172*b* of the jaws 120*a*, 120*b* are thus engaged with the projectile 918 at the full stroke of the ram plate 34. Moreover, by making use of the shoulder 922 of the cartridge case 912 and the corresponding shoulder 162 of the through hole 160 to locate the cartridge 910, and more specifically the projectile, it is possible to reliably advance the cartridge 910 to the maximum extent into the jaws 120*a*, 120*b*, without either working edge 170*a*, 170*b*, engaging the cartridge case 912. This depth of engagement leads to the jaws 120*a*, 120*b* engaging the projectile 918 at or about a local maximum diameter. This reduces the likelihood of slippage between the jaws 120*a*, 120*b*, and the projectile 918.

Further, the combined upward and outward displacement of the jaws 120*a*, 120*b* also manifests a rotation of the jaws 120*a*, 120*b*, within their permitted range of motion. Because the force applied by the working edges 170*a*, 170*b* is normal to their angle of contact with the workpiece, in this case projectile 918, the described rotation of the 120*a*, 120*b* raises working edges 170*a*, 170*b*, and thus induces an upward angle to their holding force. As the ram 20 is thereafter withdrawn from the top plate 40, again by operation of the handle 26, this time in the opposite direction, the working edges 172*a*, 172*b* of the jaws 120*a*, 120*b* remain engaged with the projectile 918. In part because of the upward component of the gripping force, the jaws 120*a*, 120*b* grip tighter to the projectile as the cartridge 910 is withdrawn. This reduces the problem of an extraction tool losing its grip on the projectile 918 during the extraction stroke.

One of the many advantages of an extraction device according to the instant disclosure lies in how removal of the projectile 918 from the extraction device 100 is effected. Once the projectile 918 is successfully extracted from its cartridge case 912, it remains held by the jaws 120*a*, 120*b* of the extraction device 100. A user of the reloading press 10 is able to clear the cartridge case 912 from the shell holder 42, taking care with any propellant that remains within the case 912 and/or a live firing primer 916.

Quite simply, the next cartridge 910 from which a projectile 918 is to be extracted is engaged with the shell holder 42. As the ram 20 is advanced towards the extraction device 100 in the top plate 40, the point of the next cartridge 910 pushes upward on an underside of the previous held projectile 918. In this stroke, the projectile 918 is moving upward through the through hole 160, and is not creating the increase in holding force described on the removal stroke. Eventually the projectile 918 from the previous cartridge 910 is pushed completely through the extraction device 100, out from between jaws 120*a*, 120*b*. The removed projectile 918 can then be made to fall in a generally predictable direction. The removed projectile 918 can therefore be readily captured, for example by a collection bin provided on or with the reloading press 10 for that purpose.

Meanwhile, once the removed projectile 918 is clear of the device 100, the projectile 918 of the next cartridge 910 is engaging the jaws 120*a*, 120*b* by its own projectile pushing on the working edges 170*a*, 170*b*. The removal cycle thus repeats. In this way, the device according to the instant disclosure enables a rapid and repeatable removal of projectiles 18 from a number of cartridges 10.

The present disclosure has been described herein with reference to certain exemplary and/or preferred embodiments. These embodiments are offered as merely illustrative, not limiting, of the scope of the present disclosure. Certain alterations or modifications may be apparent to those skilled in the art, in light of instant disclosure, without departing from the spirit or scope thereof. The full scope of Applicant's invention is defined solely with reference to the following appended claims.

The invention claimed is:

1. An ammunition projectile extraction device for removing a projectile from a cartridge case of a cartridge, the device comprising:

a body having a through hole therein, the through hole having a central defining axis thereof, the through hole further having a diameter restriction therein, the diameter restriction being dimensioned to engage a predetermined structure of the cartridge case and thereby limit the passage of the cartridge into the through hole;

a first extraction jaw having a first working edge facing towards the defining axis of the through hole for engaging a projectile;

the first extraction jaw being engaged with the body so as to permit the first extraction jaw to be displaceable relative to the body in an axial direction generally parallel with the defining axis of the through hole; and the first extraction jaw further being engaged with the body to be displaceable relative to the body in a radial direction with respect to the defining axis of the through hole, wherein at a maximum insertion of the cartridge into the through hole, the first working edge of the first extraction jaw can engage with the projectile of the cartridge, but not with the cartridge case.

2. The device according to claim 1, wherein the first working edge is hardened.

3. The device according to claim 1, further comprising:

the first working edge comprises hardened O-1 tool steel, high-speed steel, tungsten carbide, and/or a hardness-enhancing coating applied to any of them or another base material.

4. The device according to claim 1, further comprising a first notch in the first working edge generally aligned with the defining axis.

5. The device according to claim 1, further comprising:

a second extraction jaw having a second working edge facing towards the defining axis of the through hole.

6. The device according to claim 5, further comprising the first and second extraction jaws being opposed to one another across the defining axis.

7. The device according to claim 5, further comprising:

the first and second extraction jaws being among all extraction jaws of the device and further that all extraction jaws of the device are engaged with said body as part of a pattern that is spaced in azimuth around the defining axis.

8. The device according to claim 1, further comprising: the first extraction jaw further being engaged with the body to be rotatable around an axis transverse to the defining axis, whereby the first working edge is translatable in a direction away from the body to be oriented in a direction at least partially away from the body.

9. The device according to claim 1, further comprising:

a bias element biasing the first extraction jaw in one or more of a radially inward direction and an axially downward direction.

10. The device according to claim 1, further comprising:

a shank connected to the body, the shank being adapted to mate with and be held by a reloading press of ammunition cartridges.

11. The device according to claim 1, further comprising a slot in an upper surface of the body for receiving the first extraction jaw at least partially below and upper surface of the body.

12. An ammunition projectile extraction device for removing a projectile from a cartridge case of a cartridge, the device comprising:

a body having a through hole therein, the through hole having a central defining axis thereof;

a first pair of extraction jaws engaged with the body, the first pair of extraction jaws comprising first and second extraction jaws, the first and second extraction jaws each having respective first and second working edges facing towards the defining axis of the through hole for engaging a projectile;

the first and second extraction jaws being engaged with the body so as to permit the first and extraction jaws to be displaceable relative to the body in an axial direction generally parallel with the defining axis of the through hole; the first and second extraction jaws further being engaged with the body to further be displaceable relative to the body in a radial direction with respect to the defining axis of the through hole;

the first and second extraction jaws further being engaged with the body to be rotatable around an axis transverse to the defining axis, whereby the first working edge is translatable in a direction away from the body to be oriented in a direction at least partially away from the body; and a bias element biasing at least one of the first and second extraction jaw in one or more of a radially inward direction and an axially downward direction.

13. The device according to claim 12, wherein the first and second extraction jaws are each translatable in one or more of the axial direction relative to the body, the radial direction relative to the body, and rotatable around a lateral axis relative to the body, each of the first and second jaws movable independently of the other.

14. The device according to claim 12, further comprising: the through hole having a diameter restriction therein, the diameter restriction being dimensioned to engage a predetermined structure of the cartridge case and thereby limit the passage of the cartridge into the through hole, wherein at a maximum insertion of the cartridge into the through hole, the first and second working edges of the first and second extraction jaws can engage with the projectile of the cartridge, but not with the cartridge case.

15. The device according to claim 12, wherein the bias element is chosen from the group comprising a coil spring, a washer spring, a diaphragm spring, a leaf spring, a donut spring, and an elastic.

16. The device according to claim 12, further comprising: a second pair of extraction jaws engaged with the body, the second pair of extraction jaws comprising a third and a fourth extraction jaw, the third and fourth extraction jaws each having respective third and fourth working edges facing towards the defining axis of the through hole.

17. The device according to claim 16, further comprising: the third and fourth extraction jaws being engaged with the body so as to permit the third and fourth extraction jaws to be displaceable to the body in an axial direction generally parallel with the defining axis of the through hole; the third and fourth extraction jaws further being engaged with the body to be displaceable relative to the body in a radial direction with respect to the defining axis of the through hole; the third and fourth extraction jaws further being engaged with the body to be rotatable around an axis transverse to the defining axis, whereby the first working edge is translatable in a direction away from the body to be oriented in a direction at least partially away from the body; and a bias element biasing at least one of the third and fourth extraction jaw in one or more of a radially inward direction and an axially downward direction.

18. An ammunition projectile extraction device for removing a projectile from a cartridge case of a cartridge, the device comprising:

a body having a through hole therein, the through hole having a central defining axis thereof, the through hole further having a diameter restriction therein, the diameter restriction being dimensioned to engage a predetermined structure of the cartridge case and thereby limit the passage of the cartridge into the through hole;

a first extraction jaw having a first working edge facing towards the defining axis of the through hole for engaging a projectile;

the first extraction jaw being engaged with the body so as to permit the first extraction jaw to be displaceable relative to the body in an axial direction generally parallel with the defining axis of the through hole; and the first extraction jaw further being engaged with the body to be displaceable relative to the body in a radial direction with respect to the defining axis of the through hole, and the first extraction jaw further being engaged with the body to be rotatable around an axis transverse to the defining axis.

19. The device according to claim 18, further comprising: a second extraction jaw having a second working edge facing towards the defining axis of the through hole the second extraction jaw being engaged with the body so as to permit the second extraction jaw to be displaceable relative to the body in an axial direction generally parallel with the defining axis of the through hole; and the second extraction jaw further being engaged with the body to be rotatable around an axis transverse to the defining axis.

20. The device according to claim 19, further comprising the first and second extraction jaws being opposed to one another across the defining axis.

* * * * *